US008387690B2

(12) United States Patent
Menard et al.

(10) Patent No.: US 8,387,690 B2
(45) Date of Patent: Mar. 5, 2013

(54) COMPLETION METHOD FOR HORIZONTAL WELLS IN IN SITU COMBUSTION

(75) Inventors: Wendell P. Menard, Katy, TX (US); Thomas J. Wheeler, Houston, TX (US); Wayne R. Dreher, Jr., Katy, TX (US)

(73) Assignee: ConocoPhillips Company, Houston, TX (US)

( * ) Notice: Subject to any disclaimer, the term of this patent is extended or adjusted under 35 U.S.C. 154(b) by 363 days.

(21) Appl. No.: 12/873,965

(22) Filed: Sep. 1, 2010

(65) Prior Publication Data

US 2011/0094735 A1 Apr. 28, 2011

Related U.S. Application Data

(60) Provisional application No. 61/255,597, filed on Oct. 28, 2009.

(51) Int. Cl.
*E21B 43/243* (2006.01)
*E21B 43/02* (2006.01)

(52) U.S. Cl. ..... 166/261; 166/260; 166/278

(58) Field of Classification Search ..... None
See application file for complete search history.

(56) References Cited

U.S. PATENT DOCUMENTS

| | | | | |
|---|---|---|---|---|
| 6,412,557 | B1 | 7/2002 | Ayasse et al. | |
| 7,328,743 | B2 | 2/2008 | Turta et al. | |
| 7,404,441 | B2 | 7/2008 | Hocking | |
| 7,520,325 | B2 | 4/2009 | Hocking | |
| 2005/0082057 | A1 | 4/2005 | Newton et al. | |
| 2010/0139915 | A1 * | 6/2010 | Dreher et al. | 166/256 |
| 2010/0200227 | A1 * | 8/2010 | Satchell et al. | 166/256 |

* cited by examiner

*Primary Examiner* — Zakiya W Bates
(74) *Attorney, Agent, or Firm* — ConocoPhillips Company

(57) ABSTRACT

An underground reservoir is provided comprising an injection well and a production well. The production well has a horizontal section oriented generally perpendicularly to a generally linear and laterally extending, upright combustion front propagated from the injection well. The method relates to controlling location of inflow into a production well during in situ combustion. The horizontal section of the production well includes blocking agents to prevent well failure.

30 Claims, 3 Drawing Sheets

COMPLETION METHOD FOR HORIZONTAL WELLS IN IN SITU COMBUSTION

CROSS-REFERENCE TO RELATED APPLICATIONS

This application claims priority benefit under 35 U.S.C. Section 119(e) to U.S. Provisional Patent Ser. No. 61/255,597 filed on Oct. 28, 2009 the entire disclosure of which is incorporated herein by reference.

FIELD OF THE INVENTION

Embodiments of the invention relate to a process for recovering hydrocarbons with in situ combustion.

BACKGROUND OF THE INVENTION

In situ combustion (ISC) processes are applied for the purpose of recovering oil from light oil, medium oil, heavy oil and bitumen reservoirs. In the process, oil is heated and displaced to an open production well for recovery. Historically, in situ combustion involves providing spaced apart vertical injection and production wells within a reservoir. Typically, an injection well is located within a pattern of surrounding production wells. An oxidant, such as air, oxygen enriched air or oxygen, is injected through the injection well into a hydrocarbon formation, allowing combustion of a portion of the hydrocarbons in the formation in place, i.e., in situ. The heat of combustion and the hot combustion products warm the portion of the reservoir adjacent to the combustion front and drives (displaces) the hydrocarbons toward offset production wells.

In heavy oil and bitumen reservoirs, the cold hydrocarbons surrounding the production well are so viscous so as to prevent the warmed and displaced hydrocarbons from reaching the production well, and eventually quenching the combustion process. Various implementations of in situ combustion techniques, such as the "toe heel air injection" (THAI™) process, have called for the use of horizontal production wells to provide a conduit for the heated bitumen to flow from the heated region to the production wellhead. However, the THAI™ scheme, for example, relies on the deposition of petroleum coke in the slots of a perforated liner in the horizontal section of the production wellbore behind the combustion front. However, should the coke deposition not take place or not be deposited evenly enough to seal off the liner, the injected oxidant would be able to short-circuit between the injector and producer wells, bypassing the combustion front and unrecovered hydrocarbons. The resulting production of hot, rapidly expanding, combustion gases through a small number of slots could cause a liner failure if the erosional velocity is exceeded, leading to sand production into the horizontal section and eventually a catastrophic production well failure. Therefore, a need exits for an improved method for completing horizontal production wells for in situ combustion processes.

SUMMARY OF THE INVENTION

In one embodiment of the present invention, an in situ combustion process in an underground reservoir having hydrocarbons, includes the steps of: (a) providing at least one injection well for injecting an oxidant into the underground reservoir, wherein the injection well is vertically displaced within the underground reservoir; (b) providing at least one production well having a substantially horizontal section and a substantially vertical section, wherein the distal end of the substantially horizontal section extending toward the injection well includes a toe portion at one end of the horizontal section closest to the injection well and a heel portion at the opposite end of the horizontal section, wherein the heel portion connects the horizontal portion to the vertical portion of the production well, wherein the toe portion is closer to the injection well than the heel portion; (c) injecting an obstructing agent into the substantially horizontal section of the production well, wherein the obstructing agent is a highly permeable granular material; (d) injecting the oxidant into the injection well to establish a combustion front of ignited hydrocarbons within the underground reservoir; and (e) propagating the combustion front through the underground reservoir to facilitate in obtaining hydrocarbons.

In another embodiment of the present invention, an in situ combustion process in an underground reservoir having hydrocarbons, includes the steps of: (a) providing at least one injection well for injecting an oxidant into the underground reservoir; (b) providing at least one production well, wherein the production well includes a substantially horizontal section and a substantially vertical section; (c) injecting an obstructing agent into the substantially horizontal section of the production well; (d) injecting the oxidant into the injection well to establish a combustion front of ignited hydrocarbons within the underground reservoir; and (f) propagating the combustion front through the underground reservoir to facilitate in obtaining hydrocarbons.

In another embodiment of the present invention, an in situ combustion process in an underground reservoir having hydrocarbons, comprising the steps of: (a) conducting an in situ combustion in an underground reservoir; (b) recovering hydrocarbons through a production well during the in situ combustion; and (c) controlling the breakthrough of oxidants for the in situ combustion into the production well at locations along the production well, wherein the controlling is provided by an operation performed before the in situ combustion and is independent of the naturally occurring processes during in situ combustion.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

Figure 1:
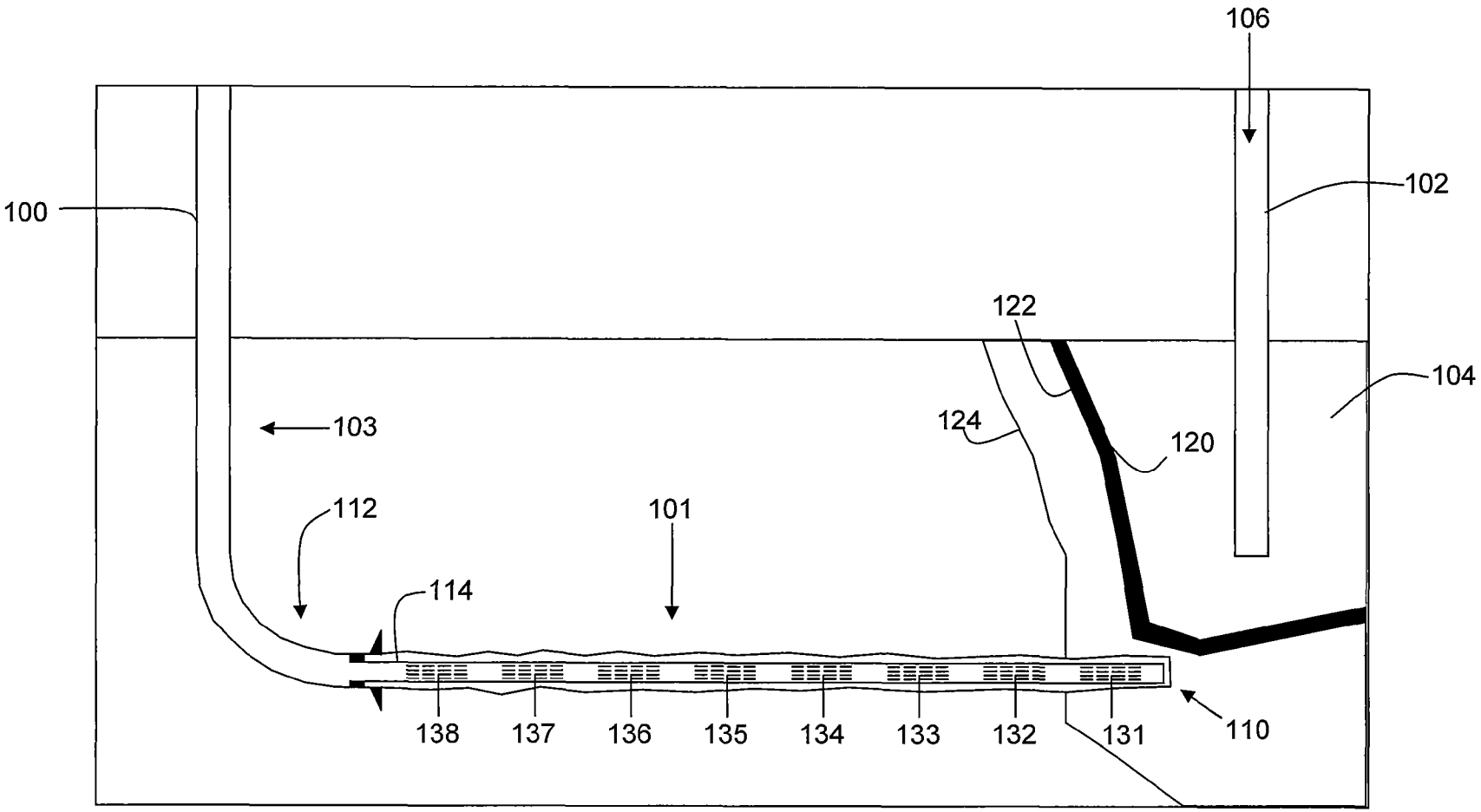
FIG. 1 is a schematic sectional view of an injection well and a production well with a slotted liner completion after commencing the initial stage of in situ combustion.

Referring to FIG. 1, an oil reservoir 104 contains an injection well 102 and a production well 100 having a horizontal section 101 and a vertical section 103. The production well 100 has the general shape of a foot, and is therefore defined by a "toe" section 110 and a "heel" section 112. The toe section 110 is located at the distal end of the horizontal section 101, while the heel portion 112 is located at the intersection of the horizontal section 101 and the vertical section 103. The injection well 102 is vertically oriented within oil reservoir 104 terminating above the toe section 110 of the production well 100.

The horizontal section 101 contains a slotted liner 114 horizontally disposed within the horizontal section 101 of the production well 100. The liner 114 contains slotted sections 131-138 at various desired locations along the length of the slotted liner 114. The slots are cut axially in the wall of the liner and are sufficiently narrow to exclude particles greater than a selected size, while allowing fluids to flow into or out of the wellbore. FIG. 1 depicts eight slotted sections 131-138; however, the number of slotted wall sections and the size of the slots are solely dependent on operational requirements and desire.

The production well 100 is generally completed low in the reservoir below the injection well 102, with the toe portion 110 of the horizontal section 101 of the production well 100 being in sufficient proximity to the injection well 102 to ensure fluid communication between the injection well 102 and the production well 100. In particular, the production well 100 evacuates combustion gases or oil in the formation 104 as the oil is heated and becomes mobile. Preheating the formation 104 around the injection well 102 with steam, for example, may facilitate establishing initial communication between the injection well 102 and the production well 100.

In operation, the in situ combustion process beings with the injection of an oxidant 106 through the injection well 102 to initiate combustion. The combustion front 120 is then propagated toward the heel 112 of the horizontal section 101 of the production well 100. FIG. 1 depicts the first stage of the combustion front 120 after progressing some distance away from the injection well 102. A steam zone 122 is created ahead of the combustion front 120. A mobile oil zone extends between the steam zone 122 and a transition boundary 124 defined as the location of the oil that is too cold and viscous to flow through the formation. The mobile oil flows through first slotted wall section 131 of the slotted liner 114 located closest to the toe 110 and the injection well 102. At this point, the combustion front 120 has not passed the first slotted section 131, but the transition boundary 124 has, allowing heated hydrocarbons to enter the slotted liner 114 through slotted wall section 131.

Figure 2:
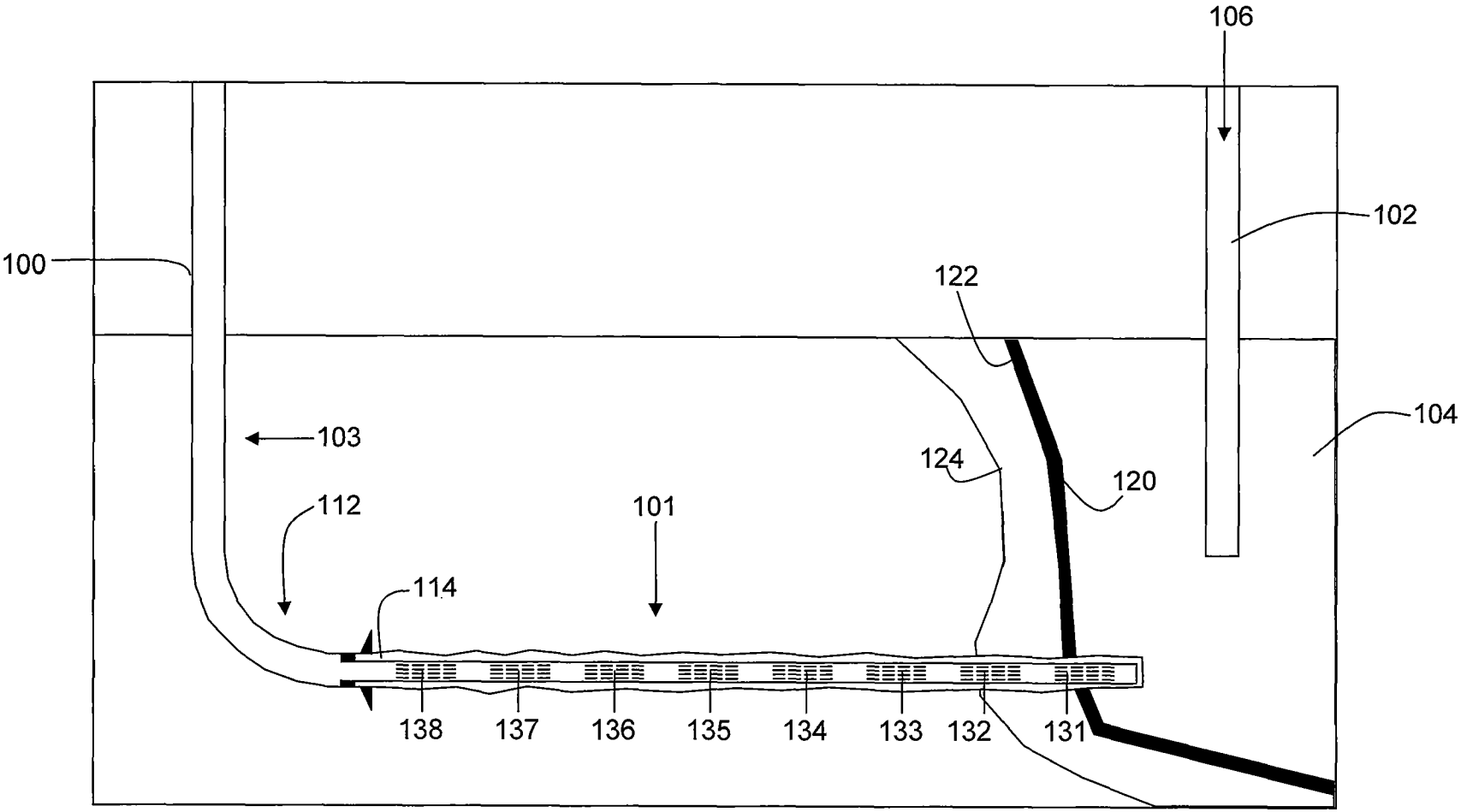
FIG. 2 is a schematic sectional view of the wells shown in FIG. 1 further illustrating the second stage of the in situ combustion, specifically illustrating short-circuiting of injected oxidant into the well.

FIG. 2 shows the same formation 104 at the second stage of the in situ combustion process. The combustion front 120 has progressed through the formation 104 toward the heel 112 of the production well 100. Clean sand occupies the space between the combustion front 120 and the injection well 102. The first slotted wall section 131 of the slotted liner 114 extends into the clean sands of the formation 104. Unless every single slot behind the burn front is completely plugged with coke deposited during combustion, the oxidant 106 can enter the slotted liner 114 through slotted section 131 which is now behind the combustion front and travel unimpeded through the slotted liner 114 to the production wellhead 100, bypassing the combustion front 120 and the unrecovered hydrocarbons. Even if only one slot is open, the high-temperature, high velocity gases can quickly erode and enlarge the slot, exacerbating the short-circuit and progressively depriving the combustion front of oxidant, eventually quenching the combustion. Additionally, the enlarged slot can allow sand to enter the horizontal section of the well, which could lead to catastrophic well failure. Furthermore, short-circuiting burdens oil handling and recovery processes due to increased levels of the oxidant 106 and flue gases in the production flow resulting in mandatory separation of the oxidant and flue gas from the oil in the production flow.

Burnt oil or coke naturally deposits in the pores of the formation as the combustion front passes. This naturally occurring deposit of coke has been theorized to also occur in the slotted liner slots, thereby preventing short-circuiting. However, the short-circuiting can continue to present a problem due to lack of adequate sealing by the deposit of coke alone.

Figure 3:
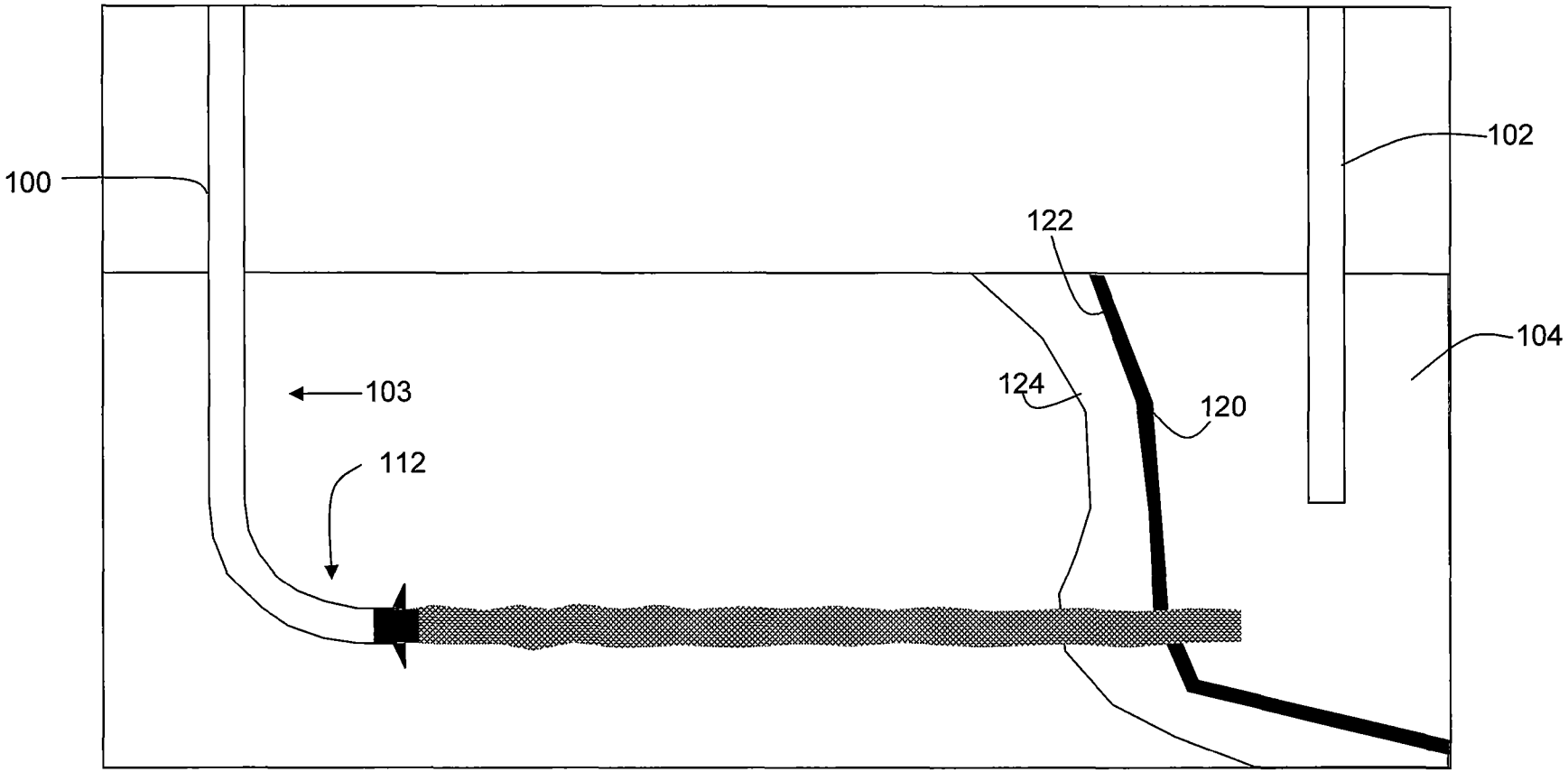
FIG. 3 is a schematic sectional view of a horizontal production well in which the horizontal open-hole portion of the well is packed with a granular material according to an embodiment of the present invention.

FIG. 3 shows formation 104 utilizing an embodiment of the present invention. The production well 100 is drilled vertically, then horizontally deviated, as before, and casing is set and cemented. The horizontal section 101 of the well is then drilled out. The open hole is backfilled with highly permeable obstructing agent, completely filling the void left by drilling the horizontal section 101. In an embodiment, the obstructing agent is a highly permeable granular material. In another embodiment, the obstructing agent is gravel pack sand. In another embodiment, the obstructing agent is frac sand. In yet another embodiment, the obstructing agent is ceramic beads. In another embodiment, the obstructing agent is bauxite.

By backfilling the horizontal section 101 with an obstructing agent, the unrestricted short circuit through the horizontal section 101 is eliminated. Filling the horizontal section 101 with an obstructing agent, such as a highly permeable granular material, provides a highly permeable flow path that is not blocked by cold bitumen. In an embodiment, the obstructing agent is coated with a resin or other material that will allow it to be pumped into the horizontal section 101, and then activated by mechanical, chemical, thermal, or other means so as to consolidate, resulting in a highly permeable, consolidated, porous media. Additionally, filling the horizontal section with an obstructing agent provides a uniform porous matrix in which coke can be deposited, much like the formation sand 104 that will not fail catastrophically. In another embodiment, a slotted liner is inserted into the horizontal section of the production well prior to the injection of the obstructing agent. The annulus between the slotted liner, the open hole, and the interior of the slotted liner are completely filled with the highly permeable obstructing agent.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. An in situ combustion process in an underground reservoir having hydrocarbons, comprising the steps of:

(a) providing at least one injection well for injecting an oxidant into the underground reservoir, wherein the injection well is vertically displaced within the underground reservoir;

(b) providing at least one production well having a substantially horizontal section and a substantially vertical section, wherein the distal end of the substantially horizontal section extending toward the injection well includes a toe portion at one end of the horizontal section closest to the injection well and a heel portion at the opposite end of the horizontal section, wherein the heel portion connects the horizontal portion to the vertical portion of the production well, wherein the toe portion is closer to the injection well than the heel portion;

(c) injecting an obstructing agent into the substantially horizontal section of the production well, wherein the obstructing agent is a highly permeable granular material and is one of gravel pack sand, frac sand, ceramic beads and bauxite;

(d) injecting the oxidant into the injection well to establish a combustion front of ignited hydrocarbons within the underground reservoir; and (e) propagating the combustion front through the underground reservoir to facilitate in obtaining hydrocarbons.

2. The method according to claim 1, wherein the obstructing agent is inserted prior to the injection of the oxidant.

3. The method according to claim 1, wherein the obstructing agent is gravel pack sand.

4. The method according to claim 1, wherein the obstructing agent is frac sand.

5. The method according to claim 1, wherein the obstructing agent is ceramic beads.

6. The method according to claim 1, wherein the obstructing agent is bauxite.

7. The method according to claim 1, wherein the obstructing agent is coated with a resin or other material that will allow it to be pumped into the horizontal section, and then activated by mechanical, chemical, thermal, or other means, so as to consolidate, resulting in a highly permeable, consolidated, porous media.

8. The method according to claim 1, wherein a slotted liner is inserted into the substantially horizontal section of the production well prior to the injection of the obstructing agent, completely filling the annulus between the slotted liner and the open hole, and also the interior of the slotted liner.

9. The method according to claim 8, wherein the slotted liner includes a plurality of slotted sections sufficiently narrow so as to exclude particles greater than a pre-determined size while allowing fluid into or out of the wellbore.

10. An in situ combustion process in an underground reservoir having hydrocarbons, comprising the steps of:

(a) providing at least one injection well for injecting an oxidant into the underground reservoir;

(b) providing at least one production well, wherein the production well includes a substantially horizontal section and a substantially vertical section;

(c) injecting an obstructing agent into the substantially horizontal section of the production well, wherein the obstructing agent is one of gravel pack sand, frac sand, ceramic beads and bauxite;

(d) injecting the oxidant into the injection well to establish a combustion front of ignited hydrocarbons within the underground reservoir; and (e) propagating the combustion front through the underground reservoir to facilitate in obtaining hydrocarbons.

11. The method according to claim 10, wherein the injection well is vertically displaced in the underground reservoir.

12. The method according to claim 10, wherein the substantially horizontal section and the substantially vertical section of the production well are connected thereto.

13. The method according to claim 10, wherein the substantially horizontal section extends toward the injection well.

14. The method according to claim 10, wherein the distal end of the substantially horizontal section extending toward the injection well includes a toe portion at one end of the horizontal section closest to the injection well and a heel portion at the opposite end of the horizontal section, wherein the heel portion connects the horizontal portion to the vertical portion of the production well, wherein the toe portion is closer to the injection well than the heel portion.

15. The method according to claim 10, wherein the obstructing agent is inserted prior to the injection of the oxidant.

16. The method according to claim 10, wherein the obstructing agent is a highly permeable granular material.

17. The method according to claim 10, wherein the obstructing agent is gravel pack sand.

18. The method according to claim 10, wherein the obstructing agent is frac sand.

19. The method according to claim 10, wherein the obstructing agent is ceramic beads.

20. The method according to claim 10, wherein the obstructing agent is bauxite.

21. The method according to claim 10, wherein the obstructing agent is coated with a resin or other material that will allow it to be pumped into the horizontal section, and then activated by mechanical, chemical, thermal, or other means, so as to consolidate, resulting in a highly permeable, consolidated, porous media.

22. The method according to claim 10, wherein a slotted liner is inserted into the substantially horizontal section of the production well prior to the injection of the obstructing agent, completely filling the annulus between the slotted liner and the open hole, and also the interior of the slotted liner.

23. The method according to claim 22, wherein the slotted liner includes a plurality of slotted sections sufficiently narrow so as to exclude particles greater than a pre-determined size while allowing fluid into or out of the wellbore.

24. An in situ combustion process in an underground reservoir having hydrocarbons, comprising the steps of:

(a) conducting an in situ combustion in an underground reservoir;

(b) recovering hydrocarbons through a production well during the in situ combustion; and (c) controlling the breakthrough of oxidants for the in situ combustion into the production well at locations along the production well, wherein the controlling is provided by an operation performed before the in situ combustion, is independent of the naturally occurring processes during in situ combustion and comprises obstructing inflow along longitudinal intervals of the production well with an obstructing agent that is one of gravel pack sand, frac sand, ceramic beads and bauxite.

25. The method according to claim 24, wherein the obstructing agent is a highly permeable granular material.

26. The method according to claim 24, wherein the obstructing agent is gravel pack sand.

27. The method according to claim 24, wherein the obstructing agent is frac sand.

28. The method according to claim 24, wherein the obstructing agent is ceramic beads.

29. The method according to claim 24, wherein the obstructing agent is bauxite.

30. The method according to claim 24, wherein the obstructing agent is coated with a resin or other material that will allow it to be pumped into the horizontal section, and then activated by mechanical, chemical, thermal, or other means, so as to consolidate, resulting in a highly permeable, consolidated, porous media.

* * * * *